United States Patent [19]

Spengler

[11] Patent Number: 4,732,592

[45] Date of Patent: Mar. 22, 1988

[54] PORTABLE CLEAN AIR FACILITY

[76] Inventor: Charles W. Spengler, 3310 Deforest Dr., Cincinnati, Ohio 45209

[21] Appl. No.: 925,436

[22] Filed: Oct. 31, 1986

[51] Int. Cl.[4] ..... B01D 46/10

[52] U.S. Cl. ..... 55/356; 55/385 A; 55/473; 55/500

[58] Field of Search ..... 55/385 A, 473, 500, 55/356; 98/31.5, 115.3

[56] References Cited

U.S. PATENT DOCUMENTS

| | | | |
|---|---|---|---|
| 3,505,989 | 4/1970 | Truhan | 55/385 A X |
| 4,202,676 | 5/1980 | Pelosi | 55/385 A X |
| 4,548,627 | 10/1985 | Landy | 55/385 A X |
| 4,549,472 | 10/1985 | Endo et al. | 55/385 A X |
| 4,553,992 | 11/1985 | Boissinot et al. | 98/115.3 X |

*Primary Examiner*—Charles Hart

*Attorney, Agent, or Firm*—Edwin E. Greigg

[57] ABSTRACT

A portable environmental clean air frame facility including a power unit section and a clean air section. The frame is formed by P.V.C. pipes and fittings so that clear plastic sheeting material may be formed and draped over the clean air section to form a clean air enclosure. The power unit section includes a blower motor having a prefilter unit on each end. One end draws air from the surrounding medium and one is connected to the clean air enclosure. The prefiltered air is directed through a HEPA filter, through an air delivery duct and into the enclosure. A bypass damper is provided for controlling the air flow velocity and for producing either a positive or negative pressure in the enclosure.

7 Claims, 4 Drawing Figures

PORTABLE CLEAN AIR FACILITY

This invention is directed to improvements of environmental clean air facilities and more particularly to an environmental clean air facility which is inexpensive to make, relative light in weight, and portable for easy movement from one place to another. Further the materials for the facility may be easily disposed of if contaminated.

Heretofore clean environmental rooms have been either fixed in place or else too cumbersome for easy movement from place-to-place. Also the prior art devices have been complicated to assemble, requiring in most cases the services of a trained engineer or mechanic. Normal units are manufactured in a factory using metal fabricating welding machines, and shipped to site and erected by mechanics.

OBJECT AND SUMMARY OF THE INVENTION

It is a principal object of the invention to provide a portable clean air room which may be constructed by the use of common, simple tools and in which the room enclosure is made of clear plastic, enabling one on the outside to clearly view the inside of the enclosure.

Another object of the invention is to provide a facility which is easily assembled by non-skilled persons to provide a clean air space.

Still another object of the invention is to provide a portable clean air room which is formed substantially of an all plastic material construction which may be assembled by use of double faced adhesive tape with a peel away covering.

It is yet another object of this invention to provide a clean air enclosure within which a person may work or within which a person may extend their arms through suitable openings for work on the inside of an environmentally clean room.

While yet another object of the invention is to provide a facility by which air flow may be controlled and either positive or negative pressure may be developed within the enclosure.

These and other features and advantages of the present invention will become more obvious from a reading of the following disclosure including the drawings.

DETAILED DESCRIPTION

Figure 1:
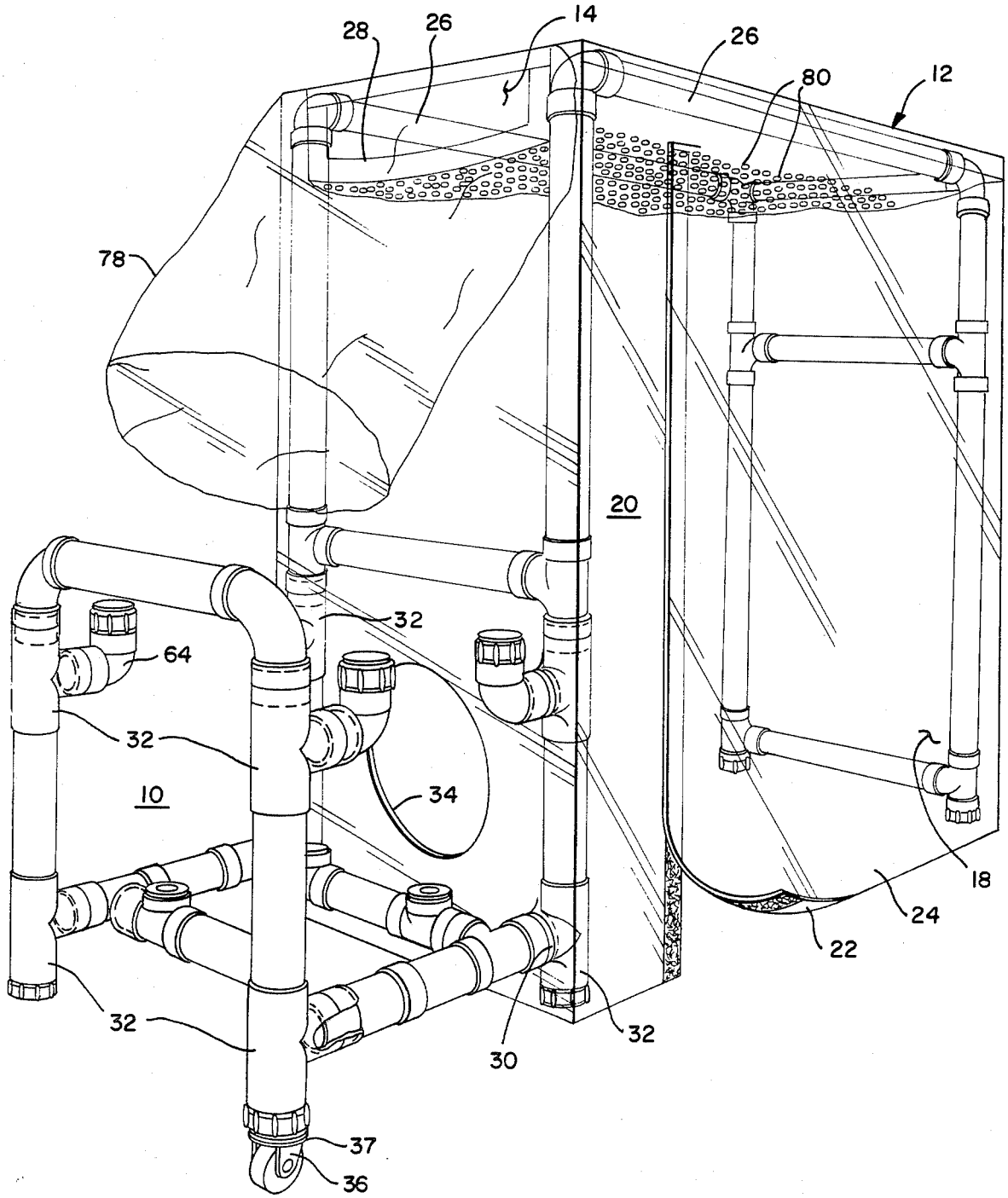
FIG. 1 illustrates a frame for a filter and power unit section, and a frame which is enclosed by a plastic sheeting material.
Figure 2:
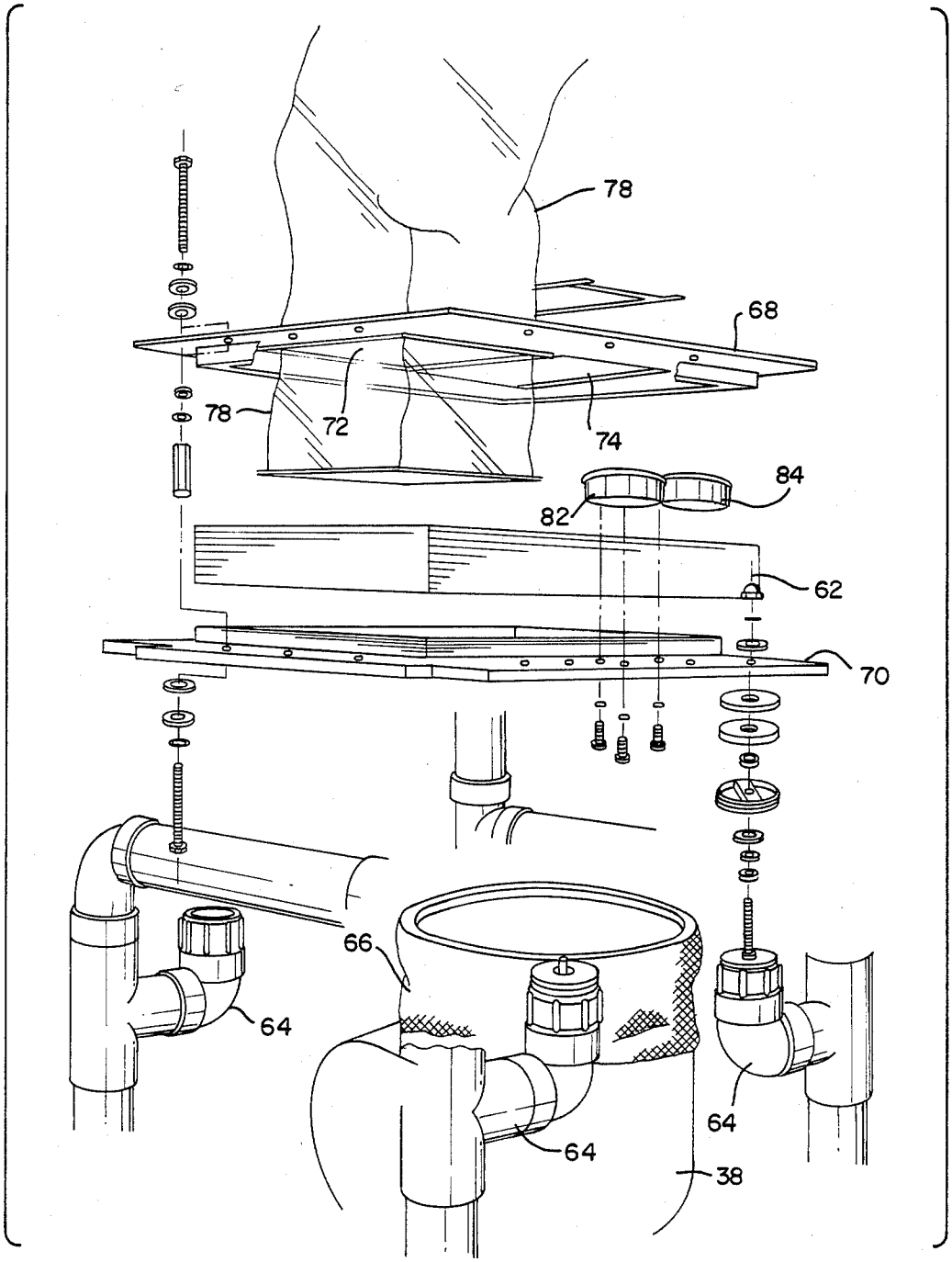
FIG. 2 illustrates an expanded filter section including the filter and connecting parts.
Figure 3:
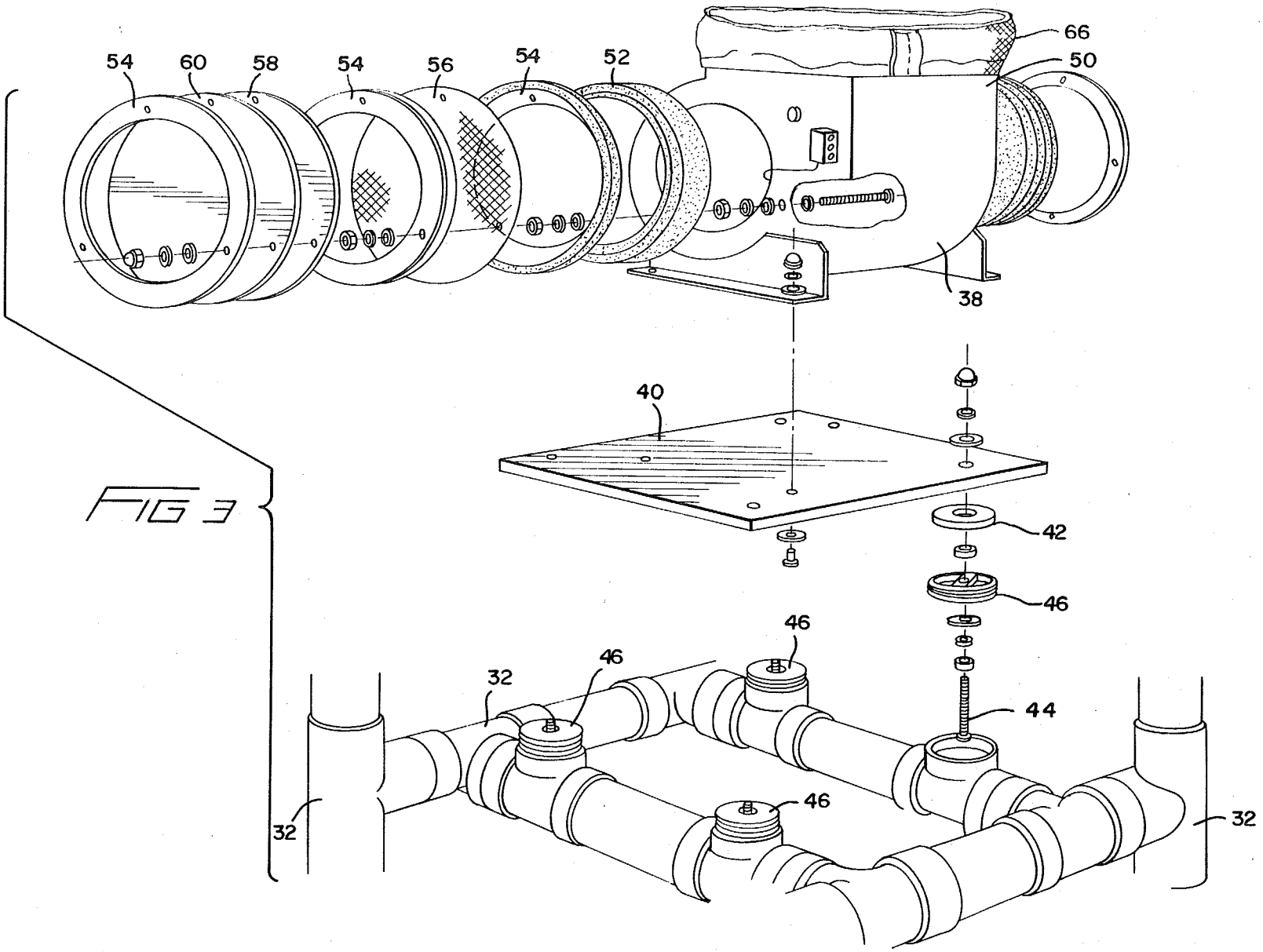
FIG. 3 illustrates an expanded view of a blower motor and the connecting filter elements for the blower.
Figure 4:
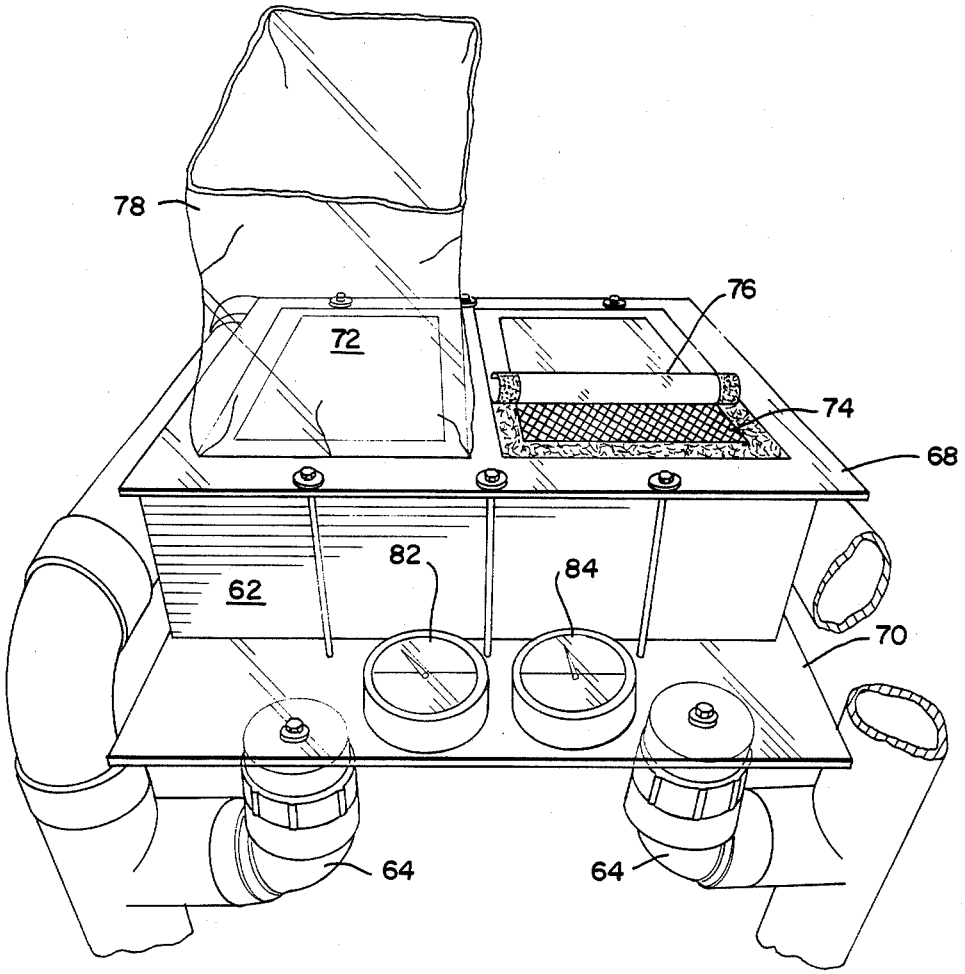
FIG. 4 is a perspective view of the filter which more clearly shows the filter element.

Now referring to the drawing there is shown a frame made of poly vinyl chloride, P.V.C., plumbing type fittings or tubes. The frame includes a power unit-filter section 10 and an environmental clean air section 12. The clean air section is surrounded by sheeting of 16 mil clear vinyl including a top panel 14, rear end panel 18, front end panel 20 and opposite side panels 22 and 24. The top section extends down over the upper horizontal parallel tubing 26 and is provided with adhesive backed VELCRO tape 28 which is secured along the outer edge surfaces. The rear end panel is provided with VELCRO tape along its inner edge surfaces on the top and the outer edge surfaces of its side edges. Each of the side panels, are provided with VELCRO along its inner, upper and side edges. Thus the edges of the upper, rear end panel and side panel may be secured together along the VELCRO taped edges.

The front end sheeting section 20 is provided with apertures at 30 which fit over the support fittings 32 before assembly so that the sheeting will fit closely around the upright supports and will extend around to the sides of the room. The upper sides edge of the front end section is provided with VELCRO on its outer surface edge and is not secured to the VELCRO on the outer surface edge of the upper section. The outer surface edges of the front end section are provided with VELCRO tape and these are secured to the VELCRO tape on the inner side surface of each of the side panels. The room will now be completely closed except for the top edge of the front end panel and the front edge of the upper section which will be explained later. The front end panel section is provided with a larger circular opening 34 which is secured to a ventilation blower which will be explained later.

The enclosure has been set forth as using VELCRO along the edges for securing the edges together. Instead of VELCRO, a double-faced adhesive tape with a peel-away covering may be used for securing the edges of the plastic sheets together. Such tape may be used except along edges of sheets which form an entrance in which VELCRO will be used such as shown for the peeled-away sheet 22 of FIG. 1 which can be used as an entrance into the enclosure.

Each of the support legs of the frame may be provided with a caster 36 which is secured to a plastic fitting that fits into the bottom of the support legs. The lower portion of the frame is provided with P.V.C. tubular cross pieces and approprate fittings for securing a four speed ventilation blower 38 to the cross pieces. The ventilation air blower is secured upon an acrylic or polycaronate material plate 40 which rests upon a shock absorbing material 42 such as neoprene. The shock absorbing material, plate and blower are secured to the cross pieces of the frame by suitable bolts 44 that are secured to a flush plug 46. The blower 38 is provided with an appropriate filter assembly on each end for filtering ambient air that enters the end 48 and the air from the environmental clean air closure connected to end 50. Elongated bolts, washers and nuts are used to secure the filter assemblies to the blower.

Each of the filter assemblies include a neoprene damper ring spacer 52 held in place on the bolts by a filter ring 54. A fiber glass window screen 56 is hold in place by a second filter ring 54 juxtaposed the first filter ring. In succession, a filter media 58 (type OP-40) and a filter media 60 (type PSF) are secured in place by a third filter ring 54. Washers and nuts may be used to secure each of the separate components onto the bolts. Three such bolts are equally spaced and used to secure the components in place.

A high efficiency particulate air filter (HEPA) 62 is formed in a housing 63 which is secured to the L-fittings 64 of the frame above the blower. The HEPA filter includes an air inlet which seats on a neoprene spacer connector 66 that connects with the outlet of the blower. The neoprene spacer connection is slightly wider than the spacing between the blower outlet and the bottom of the HEPA filter so that when the HEPA filter is placed for securing upon the spacer, the spacer is slightly compressed to provide a good seal. The top face surface of the spacer is provided with a sealant to insure that an air tight seal is made between the spacer and the bottom surface of the HEPA filter. The HEPA filter housing is secured between upper and lower plastic plates 68, 70 which have been provided with appropriate sealant at their contacting surfaces.

The HEPA filter is mounted upon the spacer between the blower and the HEPA housing. The upper surface of the HEPA filter is divided into two equal sections 72, 74. One section 74 is covered by a sheet of plastic 76 which has VELCRO along its surface which seals to strips of VELCRO that outline that sections of the filter. The other section 72 of the filter has one end of a vinyl sheet formed delivery duct 78 connected thereto by use of a double sided sealant tape. The delivery duct is closed on its opposite end 80 and passed into the environmental clean air chamber through the spacing between the upper panel 14 and the upper edge of the front end panel 20 set forth above. The downwardly extending surface of the delivery duct is punctured with a series of spaced apertures through which the air delivered to the duct portion within the clean air room pass downwardly within the clean air room. The clean air room is enclosed by securing the edges of the upper end surface of the front end panel to the delivery duct, also the front edge surface of the upper panel is secured to the delivery duct. The upper panel, front and rear end panels, and side panels are all interconnected by VELCRO secured along appropriate edges. Access to the clean air chamber is through one of the VELCRO connections between the desired panels.

During assembly, the enclosure end frame section is formed first. The front end panel is then fitted over the T-joints directed toward the power unit section before the L-fittings are connected to the T-joints and before the power unit supporting frame is secured in place. The frame assembly may be assembled using a P.V.C. sealant or by use of screws threaded into appropriate holes in the P.V.C. pipe and fittings. If screws are used the heads must be freed of any burrs.

Once the frame assembly has been assembled and the clear vinyl top, ends and sides have been formed and assembled, the blower and motor assembly with the end blower filter mounted thereon is assembled on the bottom of the power unit section. The air inlet end of the blower motor toward the enclosure is secured to the opening 34 in the front end panel. The spacer ring is secured to the upper surface of the blower and the HEPA filter is mounted onto the spacer and secured in place by the bottom plate 70. The air delivery duct is secured at one end to the filter section 72 and the closed end with the pictured apertures is passed into the clean air room and the duct is sealed therein.

Magnehelic gauges 82 and 84 may be secured to the bottom plate on either side of the HEPA filter and connections thereto made on opposite sides of the filter for determining when the filter should be changed.

OPERATION

For a positive pressure, the draped panels are closed to encompass the clean air enclosure. The blower motor is started to pull air from the enclosure and from the ambient air through the two oppositely disposed prefilters on the blower. The plastic sheet cover 76 over the open side of the HEPA filter is closed to prevent escape of air. Air is forced by the blower motor through the HEPA filter into the air delivery duct, into the clean air enclosure through the holes punched into the lower surface of the air delivery duct. The air is directed in parallel downwardly directed streams to "wash" the enclosure. The air in the clean air enclosure is then pulled from the enclosure through the prefilter end connected thereto. For adjusting the flow rate of the air into the clean air chamber, the clear plastic cover 76 over the open end of the HEPA filter is partially opened to provide an opening. The larger the opening, the less the air flow will be into the clean room.

For negative pressure operation, the air delivery duct is closed by use of a surrounding VELCRO band which is tightened around the air duct between the HEPA filter and the clean air room. The clear plastic damper covering 76 is removed entirely from the HEPA filter half. When the damper covering is removed and the air delivery duct is closed, the air from the blower motor is blocked from entering the clean air enclosure and the air is withdrawn from the clean air enclosure by the blower motor and is forced out through the HEPA filter opening from which the damper covering was removed. Thus, the enclosure may have a negative pressure.

The pressure reading on the magnehelic gauges will indicate when the prefilters need to be changed.

As an example, for illustrative purposes, a suitable frame for the clean air enclosure may be formed of three or four inch P.V.C. piping with appropriate T-joints and L-joints having the following dimensions, 72 inches long, 36 inches wide and 72 inches high. The plastic sheet for the enclosure may be 16 mils in thickness. The blower motor may be a four speed, ¾ H.P., 115 volt type. The prefilters may have an outer filter type PSF synthetic material, the inner filter may be a type DP40 media-rated @25–35 of average efficiency by ASHRAE test method 52-76. The HEPA filter must have sufficient size to accomodate any standard 24×24×5½ filter with efficiencies from 99.97–99.999 DP tested UL class 1 (Federal Standard #209B). The magnehelic gauges may be a 0–1.0 in W.G. to prefilter condition and 0–2.0 in W.G. HEPA condition 0–0.25 in W.G. enclosure positive or negative condition. The casters may be of sufficient size to support 250 lbs.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A portable quick assembly, disassembly clean air facility which includes:

a frame;

said frame including a power unit support section, a filter support section and an enclosure support section each of said support sections formed of spaced supporting means formed of P.V.C. pipe and P.V.C. fittings;

said power unit support section including a first support for supporting an air blower motor unit, and said filter support section including a second support for supporting a high efficiency particulate air filter (HEPA);

said enclosure support section including front and rear end vertically directed spaced uprights and horizontally directed spaced upper cross pieces that separate said front end from said rear end and which supports an enclosure;

said enclosure including an upper panel, a front end panel, a rear end panel and opposite side panels each of which are formed of a plastic sheet material and secured to each other by use of VELCRO or a pressure sensitive tape in an air tight manner and draped over said vertically directed uprights and over said horizontally directed cross pieces of said enclosure support section one of said side panels including an entrance sealed pressure sensitive tape.

2. A portable clean air facility as claimed in claim 1, in which said pressure sensitive tape is VELCRO.

3. A portable clean air facility as claimed in claim 1, which includes an air blower motor secured on said first support of said power unit support section, said air blower motor including oppositely disposed air inlet ends;

a HEPA filter supported on said second support of said power unit section;

means for connecting an air output of said blower motor to said HEPA filter;

means for connecting one of said oppositely disposed air inlet ends of said air blower motor to said front panel of said enclosure; and an air delivery duct formed of plastic sheet connected to an output of said motor by said HEPA filter for delivering air from said HEPA filter to said enclosure.

4. A portable clean air facility as claimed in claim 3, in which said air delivery duct includes a closed end and a portion including said closed end that extends across said enclosure section along and between said upper cross pieces;

said portion that extends across and between said upper cross pieces including spaced apertures in its bottom portion through which air is directed downwardly within said enclosure section.

5. A portable clean air facility as claimed in claim 3, in which said outlet of said HEPA filter is divided into first and second equal sections;

said air delivery duct is connected to said first outlet section; and a removable cover covers said second outlet section in an air tight manner.

6. A portable clean air facility as claimed in claim 5, in which said removable cover is a piece of plastic sheet and is secured about said second outlet by use of VELCRO.

7. A portable clean air facility as claimed in claim 1, in which said pressure sensitive tape is a double-faced adhesive tape with a peel-away covering.

* * * * *